US010894658B2

(12) United States Patent
Bellamah

(10) Patent No.: US 10,894,658 B2
(45) Date of Patent: Jan. 19, 2021

(54) RE-SEALABLE CIGARETTE PACK

(71) Applicant: Altria Client Services LLC, Richmond, VA (US)

(72) Inventor: Stephen Bellamah, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 15/912,978

(22) Filed: Mar. 6, 2018

(65) Prior Publication Data

US 2019/0276223 A1 Sep. 12, 2019

(51) Int. Cl.
*B65D 85/10* (2006.01)
*B65D 65/40* (2006.01)

(52) U.S. Cl.
CPC ..... *B65D 85/1027* (2013.01); *B65D 65/40* (2013.01); *B65D 85/1045* (2013.01)

(58) Field of Classification Search
CPC ..... B65D 85/1027; B65D 65/40; B65D 85/1045; B65D 85/1018; B65D 85/12; B65D 85/1072; B65D 85/1036
USPC ..... 206/245, 242, 259, 271, 273, 276, 274
See application file for complete search history.

(56) References Cited

U.S. PATENT DOCUMENTS 3,996,945 A 12/1976 McDowell
4,293,068 A 10/1981 Focke et al.
4,300,676 A 11/1981 Focke et al.
4,375,260 A 3/1983 Focke et al.
4,555,027 A 11/1985 Froom
4,607,748 A 8/1986 Focke
4,712,689 A 12/1987 Froom
4,763,779 A 8/1988 Focke et al.
4,771,882 A 9/1988 Lowe et al.
4,942,961 A 7/1990 Focke et al.
5,018,625 A 5/1991 Focke et al.
5,022,950 A 6/1991 Ingalls et al.
5,080,227 A 1/1992 Focke
5,096,113 A 3/1992 Focke
(Continued)

FOREIGN PATENT DOCUMENTS

DE 102016012300 A1 4/2018
EP 3009374 A1 4/2016
(Continued)

OTHER PUBLICATIONS

Extended European Search Report dated Apr. 12, 2018 in corresponding European Patent Application No. 17196271.5-1016 (9 pages).

(Continued)

*Primary Examiner* — Rafael A Ortiz
(74) *Attorney, Agent, or Firm* — Buchanan Ingersoll & Rooney PC

(57) ABSTRACT

A container for consumer goods includes a rigid outer box, an inner package, an inner frame and a pull tab. The outer box has a hinged lid configured to provide access to an inner volume of the outer box. The inner frame is paperboard having a pre-cut opening configured to provide access to an inner volume of the inner package. The pull tab covers the opening with a first adhesive that releasably adheres an edge portion of the pull tab to the inner frame and a second adhesive that permanently adheres the pull tab to the inner package and the outer box.

8 Claims, 11 Drawing Sheets

(56) References Cited

U.S. PATENT DOCUMENTS

| | | | | |
|---|---|---|---|---|
| 5,158,664 | A * | 10/1992 | Colgan | B65D 85/1045 206/242 |
| 5,788,065 | A | 8/1998 | Focke | |
| 5,914,165 | A | 6/1999 | Freedman | |
| 6,000,539 | A | 12/1999 | Stewart-Cox et al. | |
| 6,132,349 | A | 10/2000 | Yokoyama | |
| 6,164,444 | A * | 12/2000 | Bray | B65D 75/5838 206/268 |
| 6,237,760 | B1 | 5/2001 | Parker et al. | |
| 6,478,149 | B1 | 11/2002 | Parker | |
| 6,481,259 | B1 | 11/2002 | Durney | |
| 6,505,735 | B1 | 1/2003 | Parker | |
| 6,606,840 | B2 | 8/2003 | Focke et al. | |
| 6,692,835 | B1 * | 2/2004 | Tomel, Jr. | B32B 15/12 131/358 |
| 6,736,262 | B2 | 5/2004 | Focke et al. | |
| 6,874,623 | B2 | 4/2005 | Bray | |
| 6,877,349 | B2 | 4/2005 | Durney et al. | |
| 6,974,406 | B2 | 12/2005 | Antonacci | |
| 7,455,177 | B2 * | 11/2008 | Serafini | B65D 5/4204 206/265 |
| 7,533,773 | B2 | 5/2009 | Aldridge et al. | |
| 7,827,769 | B2 | 11/2010 | Bertuzzi et al. | |
| 7,862,869 | B2 | 1/2011 | Papenfuss et al. | |
| 8,091,703 | B2 | 1/2012 | Marchetti et al. | |
| 8,123,030 | B2 | 2/2012 | Hein | |
| 8,276,750 | B2 | 10/2012 | Biondi et al. | |
| 8,418,845 | B2 | 4/2013 | Tawada et al. | |
| 8,474,612 | B2 | 7/2013 | Bertuzzi et al. | |
| 8,556,072 | B2 | 10/2013 | Bertuzzi et al. | |
| 8,590,701 | B2 | 11/2013 | Bertuzzi et al. | |
| 8,671,648 | B2 | 3/2014 | Bertuzzi et al. | |
| 8,783,454 | B2 | 7/2014 | Igo | |
| 8,827,145 | B2 | 9/2014 | Hultberg et al. | |
| 9,033,141 | B2 | 5/2015 | Ghini et al. | |
| 9,089,165 | B2 | 7/2015 | Bertuzzi et al. | |
| 9,254,938 | B2 | 2/2016 | Iwata et al. | |
| 9,359,124 | B2 | 6/2016 | Lutzig | |
| 9,382,062 | B2 | 7/2016 | Mitten et al. | |
| 9,499,331 | B2 | 11/2016 | Seyfferth De Oliveira | |
| 9,533,821 | B2 | 1/2017 | Buse | |
| 9,714,134 | B2 | 7/2017 | Tacchi et al. | |
| 10,053,273 | B2 | 8/2018 | Petrucci et al. | |
| 2005/0041889 | A1 | 2/2005 | Scarberry | |
| 2005/0130822 | A1 | 6/2005 | Rath | |
| 2005/0252796 | A1 | 11/2005 | Sendo | |
| 2006/0011504 | A1 | 1/2006 | Gosebruch et al. | |
| 2006/0021883 | A1 | 2/2006 | Focke et al. | |
| 2006/0037876 | A1 | 2/2006 | Fath et al. | |
| 2006/0231431 | A1 | 10/2006 | Tambo | |
| 2008/0230410 | A1 | 9/2008 | Jones et al. | |
| 2009/0071852 | A1 | 3/2009 | Negrini | |
| 2009/0177717 | A1 | 7/2009 | Meehan et al. | |
| 2009/0184158 | A1 | 7/2009 | Lutzig et al. | |
| 2009/0308766 | A1 | 12/2009 | Polloni et al. | |
| 2010/0163563 | A1 | 7/2010 | Lutzig | |
| 2011/0114518 | A1 | 5/2011 | Hein | |
| 2011/0180432 | A1 | 7/2011 | Blick et al. | |
| 2012/0111746 | A1 | 5/2012 | Tanbo et al. | |
| 2012/0177307 | A1 | 7/2012 | Duan et al. | |
| 2012/0241339 | A1 | 9/2012 | Buse et al. | |
| 2012/0291401 | A1 | 11/2012 | Mitten et al. | |
| 2014/0079343 | A1 | 3/2014 | Lyzenga et al. | |
| 2014/0110286 | A1 | 4/2014 | Bertuzzi et al. | |
| 2014/0374290 | A1 | 12/2014 | Seyfferth De Oliveira | |
| 2015/0021219 | A1 | 1/2015 | Seyfferth De Oliveira | |
| 2015/0034509 | A1 | 2/2015 | Seyfferth De Oliveira | |
| 2015/0041346 | A1 | 2/2015 | Seyfferth De Oliveira | |
| 2015/0320111 | A1 * | 11/2015 | Slooff | A24F 15/12 206/242 |
| 2015/0375923 | A1 | 12/2015 | Pilzecker | |
| 2016/0236855 | A1 | 8/2016 | Chatelain et al. | |
| 2016/0368645 | A1 | 12/2016 | Buse | |
| 2017/0036849 | A1 | 2/2017 | Mitten et al. | |
| 2017/0152100 | A1 | 6/2017 | Polloni et al. | |
| 2017/0275082 | A1 * | 9/2017 | Krasiev | B65D 75/5838 |
| 2017/0313449 | A1 * | 11/2017 | Fallon | B65B 19/025 |
| 2017/0334634 | A1 | 11/2017 | Bray et al. | |
| 2017/0341852 | A1 | 11/2017 | Bray et al. | |
| 2018/0016089 | A1 * | 1/2018 | Polloni | B65D 85/1081 |

FOREIGN PATENT DOCUMENTS

| | | | |
|---|---|---|---|
| WO | 2008142540 | A1 | 11/2008 |
| WO | 2013120916 | A1 | 8/2013 |
| WO | 2014195008 | A2 | 12/2014 |
| WO | 2016059077 | A1 | 4/2016 |
| WO | 2016087819 | A1 | 6/2016 |
| WO | 2016102461 | A1 | 6/2016 |
| WO | 2016120674 | A1 | 8/2016 |
| WO | 2017002002 | A1 | 1/2017 |
| WO | 2017134565 | A1 | 8/2017 |
| WO | 2018024375 | A1 | 2/2018 |
| WO | 2018146631 | A2 | 8/2018 |

OTHER PUBLICATIONS

International Search Report and Written Opinion dated Feb. 14, 2018 in corresponding International Patent Application No. PCT/US2017/056272, (12 pages).

International Search Report and Written Opinion dated Apr. 23, 2018 in corresponding International Patent Application No. PCT/US2018/020127, (13 pages).

Third Party Observation dated Nov. 16, 2018 in corresponding International Patent Application No. PCT/US2018/020127, 4 pages.

International Search Report and Written Opinion dated Jun. 25, 2019 in corresponding International Patent Application No. PCT/US2019/20180, 15 pages.

* cited by examiner

RE-SEALABLE CIGARETTE PACK

FIELD OF THE INVENTION

The present disclosure relates to a package for consumer goods and particularly to a re-sealable cigarette pack.

BACKGROUND

Numerous approaches have been made for packaging consumer goods. In the case of cigarettes, for example, packages are designed to preserve the flavor and freshness of the consumer goods and also protect the goods from contamination. Known packages employ outer containers having a hinged lid providing access to an inner container with an opening for accessing the consumer goods. The outer containers are generally formed of a rigid paperboard, cardboard, or other suitable material. The inner container is generally formed of a material or combination of materials having substantially less rigidity than the outer container. For example, the inner container is known to be formed of paperboard, packing material, paper, and/or aluminium. In known designs, a label with a tacky substance for sealing and re-sealing can be used to cover the opening of the inner container.

SUMMARY

A container of consumer goods includes a rigid outer box having a hinged lid configured to provide access to an inner volume of the outer box; an inner package containing the consumer goods, an inner frame having an opening configured to provide access to the consumer goods; and a pull tab covering the opening, the pull tab having a first adhesive that releasably adheres the pull tab to portions of the inner frame surrounding the opening and a second adhesive that permanently adheres the pull tab to the inner package and the outer box.

An inner frame blank for forming the inner frame comprises a front panel, a top panel with left and right dust flaps, a left side panel and a right side panel, the top panel connected to the front panel at a first transversely extending fold line, the left side panel connected to the front panel at a first longitudinally extending fold line, the right side panel connected to the front panel at a second longitudinally extending fold line, and the opening extending part way across the top panel and part way down the front panel, the left dust flap at least partly overlapping the left side panel when the left dust flap and left side panel are folded 90 degrees and the right dust flap at least partly overlapping the right side panel when the right dust flap and the right side panel are folded 90 degrees. An inner frame can be formed from the inner frame blank by folding the top panel 90 degrees with respect to the front panel, folding the left side panel 90 degrees with respect to the front panel, folding the right side panel 90 degrees with respect to the front panel, folding the left dust panel 90 degrees with respect to the top panel and folding the right dust panel 90 degrees with respect to the top panel.

A container can be assembled from the rigid outer box, the inner package, the pull tab and the inner frame by wrapping a bundle of cigarettes in the inner package, placing the inner frame over an upper end of the inner package, placing the pull tab on the inner frame and attaching the pull tab to the inner package and hinged lid such that a first adhesive releasably adheres the pull tab to portions of the inner frame surrounding the opening and a second adhesive adheres the pull tab to the inner package and a hinged lid of the rigid outer box.

The inner frame can be sized such that the top panel overlies a top face of the inner package, the front panel overlies an upper portion of a front face of the inner package, the left dust flap and left side panel overlie an upper portion of a left side face of the inner package, and the right dust flap and right side panel overlie an upper portion of a right side face of the inner package.

Preferably, the inner frame does not overlie any part of a rear face of the inner package. The second adhesive can include first and second zones of permanent adhesive wherein the first zone attaches a first end of the pull tab to an outer surface of the inner package and the second zone attaches a second end of the pull tab to an inner surface of the hinged lid.

In an embodiment, the inner package comprises an inner paper layer and an outer foil layer, the inner package covers the cigarettes except in an area corresponding to the opening in the inner frame, and/or the inner package comprises a paper layer wrapped around the cigarettes, the paper layer comprising a mentholated layer of paper in contact with the cigarettes.

BRIEF DESCRIPTION OF THE DRAWING FIGURES

The scope of the present disclosure is best understood from the following detailed description of exemplary embodiments when read in conjunction with the accompanying drawings.

Figure 10A:
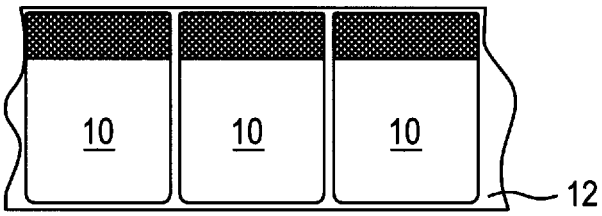
Figure 10B:
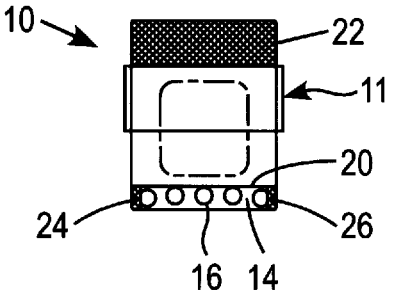
Figure 10C:
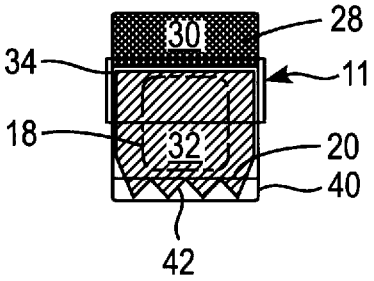
Figure 10D:
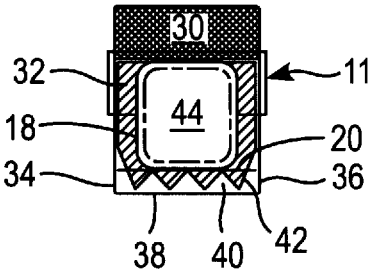
Figure 10E:
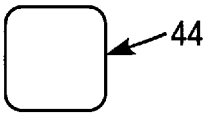

FIGS. 10A-E show details of a pull tab in accordance with an embodiment wherein FIG. 10A shows a succession of pull tabs on a backing strip, FIG. 10B shows an outer side of the pull tab with dots of permanent adhesive, FIG. 10C shows an underside of the pull tab with zones of permanent adhesive and re-stick adhesive, FIG. 10D shows an underside of the pull tab with a piece of foil/paper at a location which overlies an extraction opening in the inner frame, and FIG. 10E shows a piece of the foil/paper which is adhered to the underside of the pull tab.

FIGS. 11A-H show details of the pull tab with areas of the restick adhesive deadened to allow easier peeling of the pull tab from the inner frame.

Figure 12:
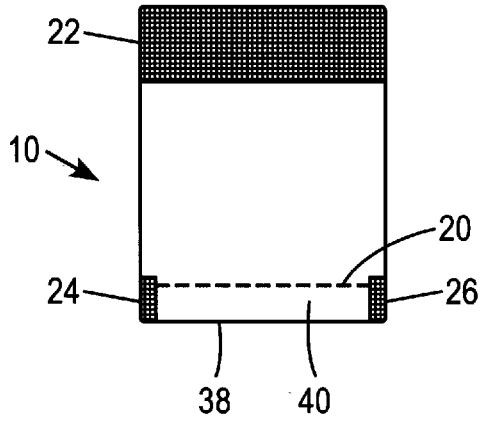

FIG. 12 shows details of a pull tab having three machine readable markings on an outer surface thereof.

Figure 13:
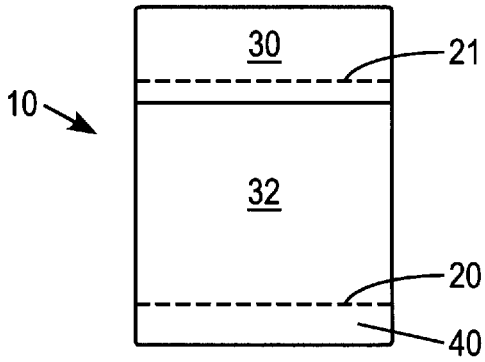

FIG. 13 shows details of a pull tab having an upper line of weakness to align with a corner of the inner package between the back wall and the top wall of the inner package.

Figure 14:
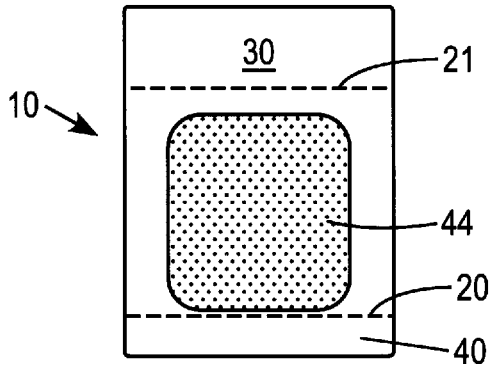

FIG. 14 shows a liner applied to the inner surface of the pull tab shown in FIG. 13.

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes such modifications and variations.

Exemplary embodiments of the present disclosure are directed to a container for consumer goods having a foil wrapped inner package, an inner frame and a rigid outer box. The outer box has a hinged lid that opens and closes to allow access the inner package. The inner package has an opening for accessing the consumer goods. The opening is covered by a re-sealable pull-tab. An inner surface of the hinged lid is optionally arranged to rotate about a fold line based on a tension force applied to the inner surface via the pull tab when the hinged lid is opened and closed. The inner package has an inner layer of paper contacting the consumer goods. According to an exemplary embodiment the re-sealable pull-tab has one or more layers where an innermost layer is composed of paper or bundle wrap comprising an outer foil layer and an inner paper payer. The pull-tab can be permanently connected to the inner package and the inner surface of the hinged lid. The pull-tab can also include a resealable adhesive which contacts the inner frame. The inner package can be impregnated with menthol which migrates to the consumer goods during storage to provide menthol flavouring to the consumer goods.

Figure 1:
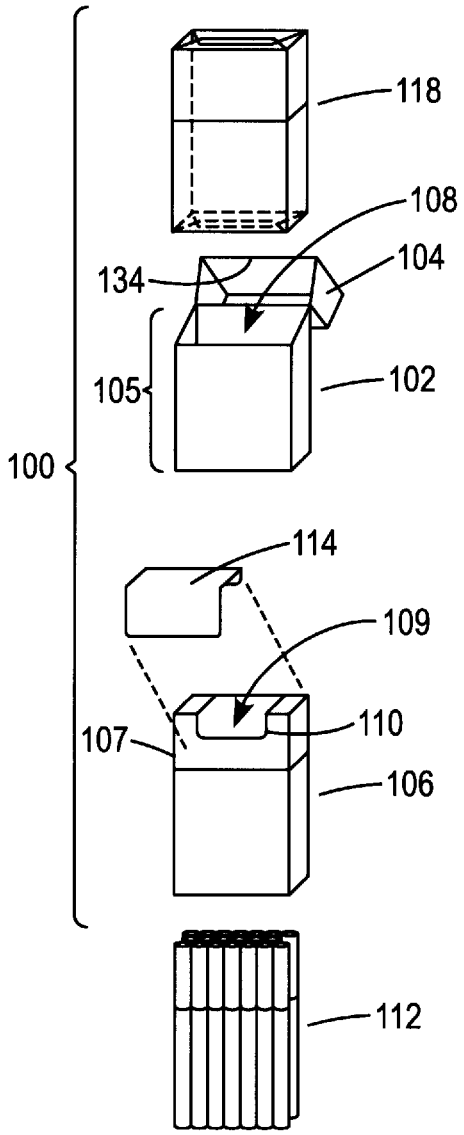
FIG. 1 illustrates an exploded view of a container for consumer goods in accordance with an exemplary embodiment.

FIG. 1 illustrates a layout of a container for consumer goods in accordance with an exemplary embodiment of the present disclosure. As shown in FIG. 1, the container 100 includes a rigid outer box 102 having a hinged top 104 configured to provide access to an inner package 106 and having a body 105 within which the inner package 106 is deposited. The inner package 106 is covered on top with an inner frame 107 having an opening 110 configured to provide access to consumer goods 112 stored or contained within an inner volume 109. The inner package 106 is of sufficient size to slidably and snugly fit within an inner volume 108 of the outer box 102. The inner package 106 can be securely held within the outer box 102 via contact friction between the surfaces of the inner package 106 and outer box 102. A pull tab 114 is arranged to cover the opening 110.

Figure 2:
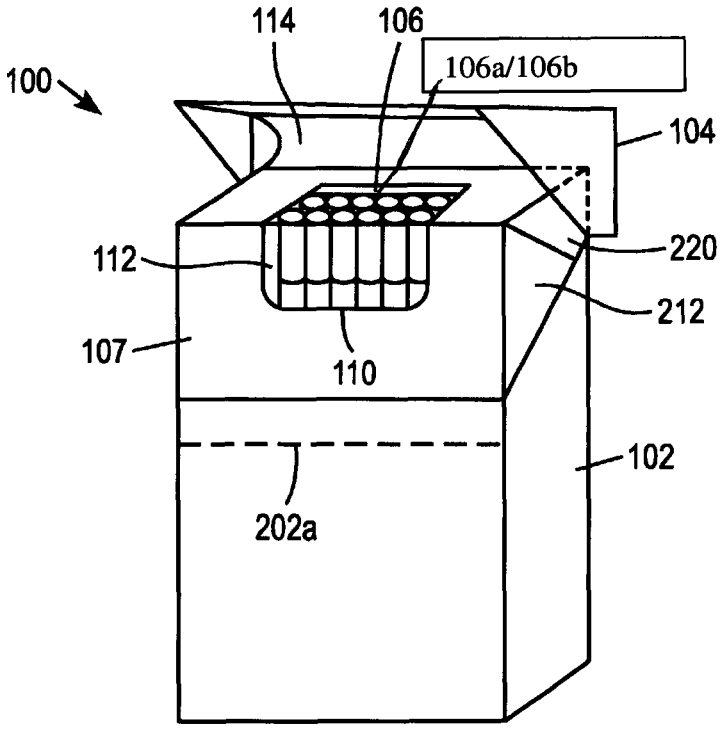
FIG. 2 illustrates a perspective view of the container in accordance with an exemplary embodiment.

FIG. 2 illustrates the assembled container 100 with the hinged lid 104 of the rigid outer box 102 in an opened condition to provide access to the inner package 106 containing consumer goods 112 such as cigarettes. As shown, the inner frame 107 has the access opening 110 through which the consumer goods can be removed from the inner package 106. The pull tab 114 is attached to the inner package 106 and the hinged lid 104 such that opening the hinged lid 104 uncovers the opening 110. Upon closing the hinged lid 104, the pull tab 114 resealably covers the opening 110.

Figure 3:
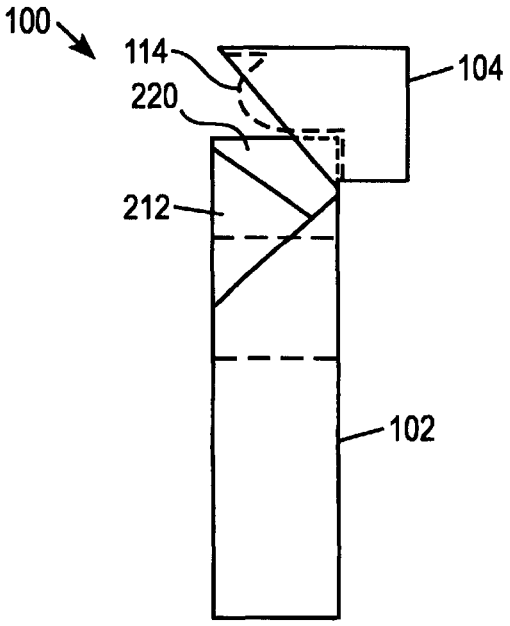
FIG. 3 illustrates a side view of the container in accordance with an exemplary embodiment.

FIG. 3 is a side view of container 100 wherein the inner frame 107 has a right side panel and right top dust flap overlapped with a portion inside the rigid outer box 102 and a portion exposed above a lower portion of the rigid outer box 102. The rigid outer box 102 can include one or more layers such as cardboard, paperboard, or any other suitable material as desired. According to an exemplary embodiment, the rigid outer box can be formed of Promina SBS C1S Paperboard. According to another exemplary embodiment, the rigid outer box can be of paperboard which is embossed with a design, lettering, pattern, and/or symbol as desired. The rigid outer box can include one or more layers such as ink, varnish, metallization, or other suitable material for product identification. When the container 100 is fully assembled, the rigid outer box 102 can be wrapped with a transparent layer such as a polypropylene film having a tear tape that allows for tearing open the polypropylene film.

Figure 9:
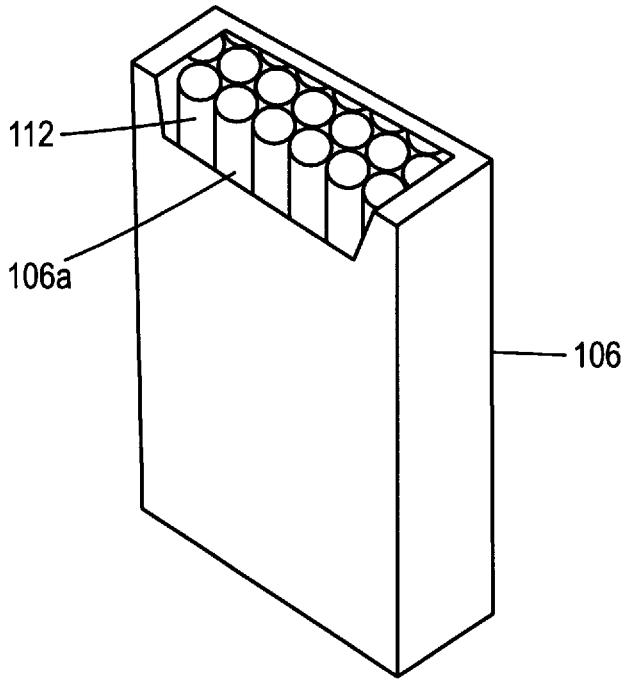
FIG. 9 illustrates an inner package of the container in accordance with an exemplary embodiment.

The inner package 106 can include a plurality of layers such as bundle wrap comprising a foil layer 106*a* and a paper layer 106*b* as an inner liner bound by an adhesive. The paper layer is the layer closest to or in contact with the consumer goods 112 stored in the inner package 106. According to an exemplary embodiment, the adhesive used to bind the layers of the bundle wrap can include at least sodium silicate or any other suitable material as desired. The inner package 106 preferably comprises bundle wrap wrapped around a bundle of cigarettes as shown in FIG. 9 wherein the inner package 106 includes an opening 106*a* extending part way down the front face and part way across the top face of the of the inner package 106. Thus, when the inner frame 107 is placed on the inner package 106 and the pull tab 114 is placed on the inner frame 107, the pull tab covers the opening 110 in the inner frame and the opening 106*a* in the inner package 106.

Figure 4:
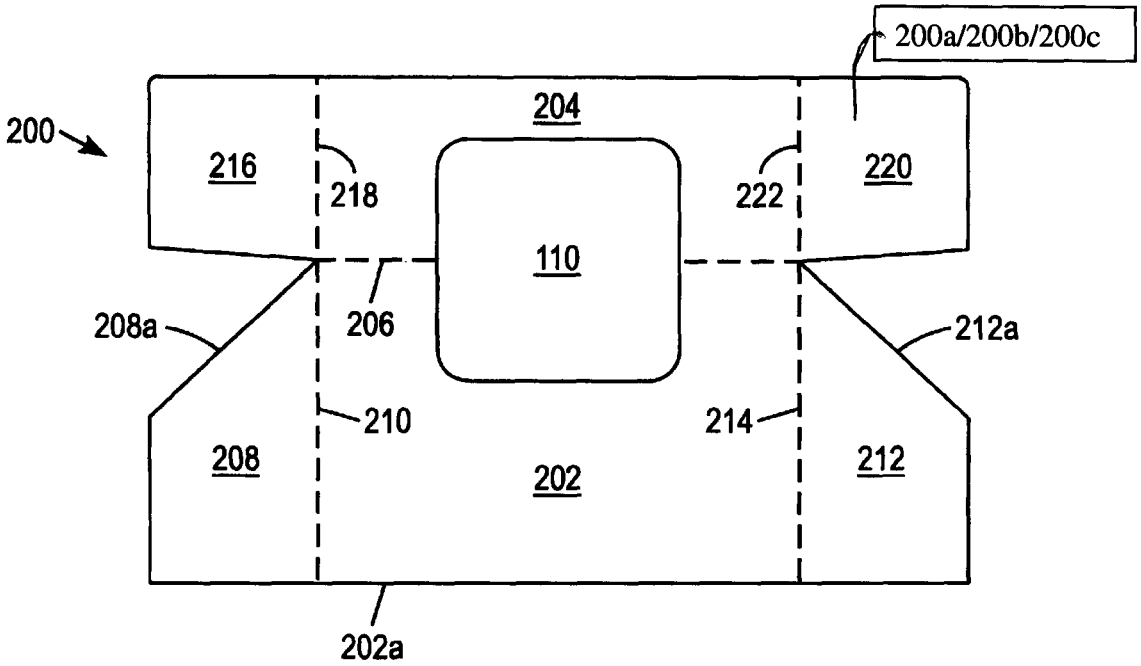
FIG. 4 illustrates an inner frame blank for forming the inner frame of the container in accordance with an exemplary embodiment.

FIG. 4 shows a blank 200 which can form the inner frame 107 which can include one or more layers such as cardboard, paperboard or other suitable material. Preferably, the inner frame 107 is made of paperboard and more preferably of foil lined paperboard for barrier requirements. In accordance with another exemplary embodiment, the inner frame 107 can comprise a blank 200 comprising an outer layer of paperboard 200*a*, an inner layer of paper 200*c*, and intermediate layer of metal foil 200*b*. The inner frame 107 can also include a layer formed on an outer surface such as a polypropylene film or a metallized polyester (MET) material such that the layer structure of the inner frame 107 includes a paperboard/MET or paperboard/film layered structure. The blank 200 for forming the inner frame 107 includes a front panel 202 connected to a top panel 204 by a transverse fold line 206, a left side panel 208 connected to a left side of the front panel 202 by a longitudinal fold line 210, a right side panel 212 connected to a right side of the front panel 202 by a longitudinal fold line 214, a left dust flap 216 connected to a left side of the top panel 204 by a longitudinal fold line 218, and a right dust flap 220 connected to a right side of the top panel 204 by a longitudinal fold line 222. The side panels 208, 212 are trapezoidal with top edges 208*a*, 212*a* forming an acute angle such as 30 to 60° or about 45° with lower edges 216*a*, 220*a* of the dust flaps 216, 220. When folded, the blank 200 fits over the top of the inner package 106 such that an opening 110 in the blank 200 overlies an opening in the inner package 106 to allow removal of the consumer goods 112, the front panel 202 lies against an upper portion of the front of the inner package 106, the side panels 208, 212 and dust flaps 216, 220 lie against upper portions of the sides of the inner package 106, and the top panel 204 lies against a top of the inner package 106. When the assembled inner package 106 and inner frame 107 are placed in the rigid outer box 102, a lower end 202*a* of the front panel 202 extends below an upper portion of a front panel of the rigid outer box 102, as shown in FIG. 2.

Figure 5:
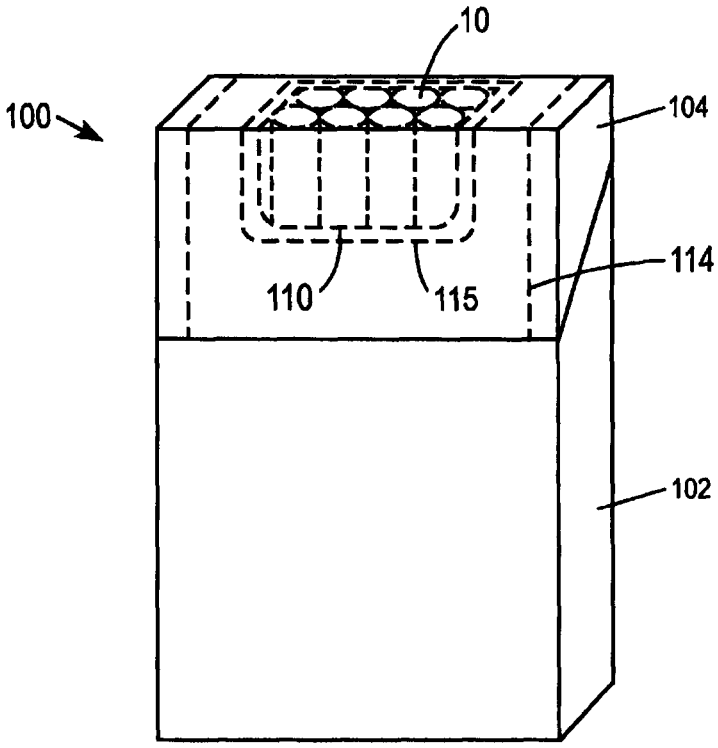
FIG. 5 illustrates the container in a closed condition in accordance with an exemplary embodiment.

As shown in FIG. 5, the pull tab 114 (shown in dotted lines) covers the opening 110 when the hinged lid 104 is closed. The pull tab 114 includes a permanent adhesive layer on an inner surface thereof for adhering the pull tab 114 to an upper back portion of the inner package 106 and a permanent adhesive layer on an outer surface thereof that attaches the pull tab 114 to an inner surface of the hinged lid 104 of the rigid outer box 102. The pull tab 114 includes a releasable adhesive on the inner surface which adheres to the inner frame 107 when the hinged lid 104 is closed. The pull tab 114 can also include a cover 115 (shown in dotted lines) for covering the opening 110 when the hinged lid 104 is closed. The cover 115 can include a paper layer or laminate of a foil layer and paper layer adhered to the inner surface of the pull tab 114 such that the paper layer contacts the consumer goods 112.

Figure 6:
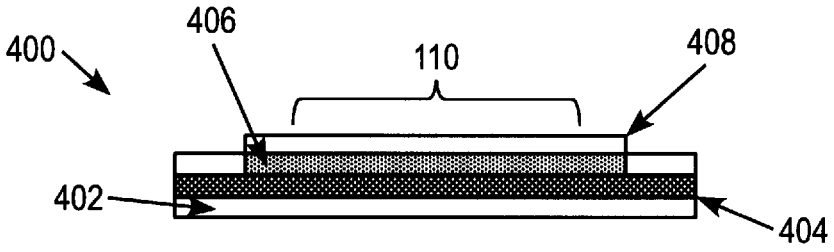
FIG. 6 illustrates details of a pull tab in accordance with an exemplary embodiment.

FIG. 6 illustrates a cross-section of a pull tab 400 of the container 100 in accordance with an exemplary embodiment of the present disclosure. The pull tab 400 can include a plurality of layers defined by layers 402, 404, 406, 408 wherein the layer 402 can be a generally rectangular polymer sheet defining the overall shape of the pull tab 114, 404 can be a layer of adhesive such as areas of permanent and/or resealable adhesive covering some or all of an inner surface of the sheet 402, 406 can be a foil layer smaller than the size of the sheet 402 but larger than the opening 110 in the inner frame 107, and 408 can be a paper layer having the same size as foil layer 406. The paper layer 408 can be a layer of bundle wrap which includes foil layer 406 and the bundle wrap 406/408 can be adhered to the sheet 402 by adhesive covering an outer side of the bundle wrap with the paper layer 408 forming the innermost layer of the pull tab 114 which contacts the consumer articles in the inner package.

Figure 7:
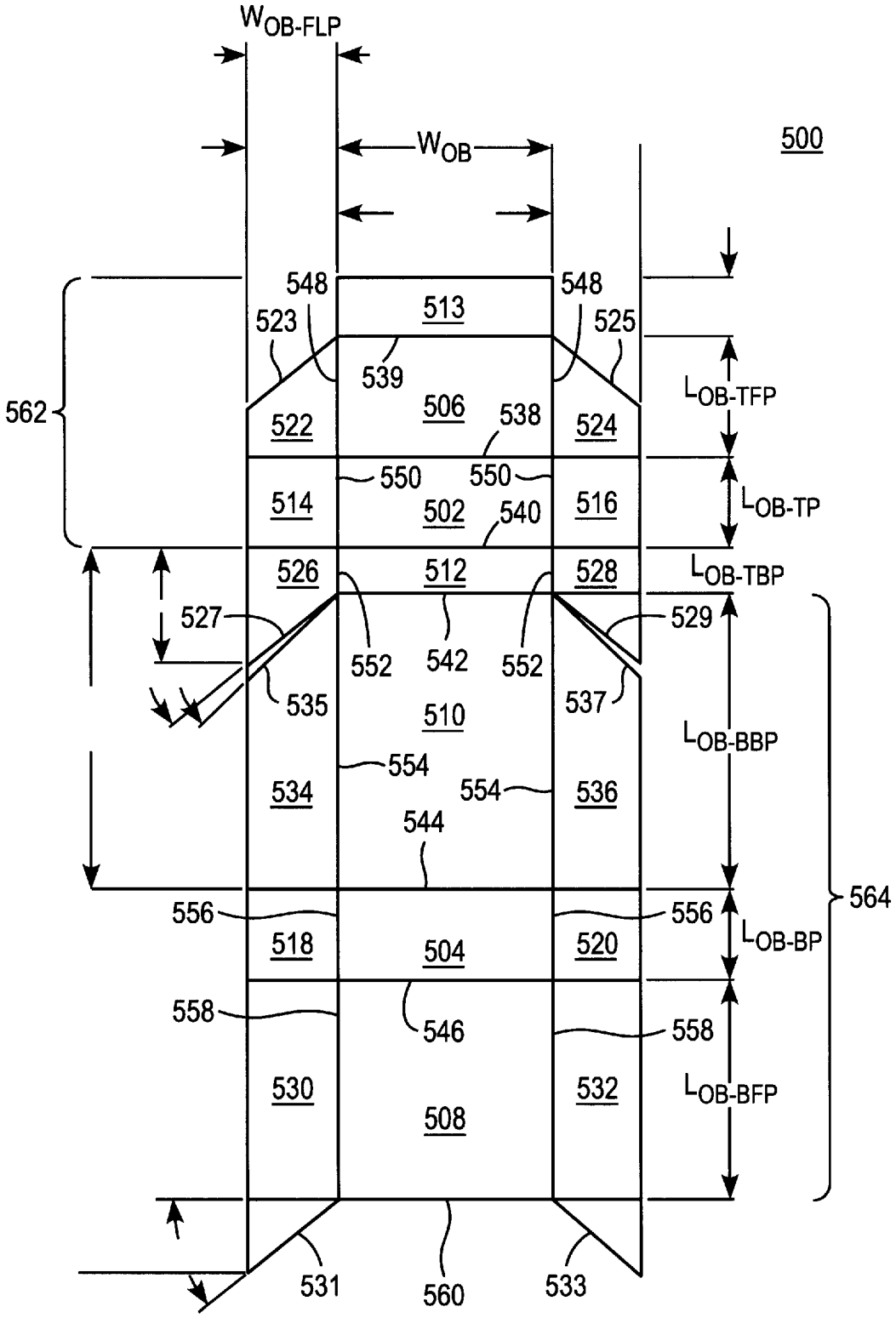
FIG. 7 illustrates a box blank for forming the outer box of the container in accordance with an exemplary embodiment.

FIG. 7 illustrates a planar view of an outer box blank of the container in accordance with an exemplary embodiment of the present disclosure. As shown in FIG. 7, the blank 500 for forming outer box 102 includes a top panel 502, a bottom panel 504, a top front panel 506, a bottom front panel 508, a bottom back panel 510, and a top back panel 512. The top panel 502 includes a front flap 513. The top panel 502 and the bottom panel 504 include left and right dust flaps. The top panel 502 includes a left dust flap 514 and a right dust flap 516, and the bottom panel 504 includes a left dust flap 518 and a right dust flap 520. An upper section 562 of the outer box blank 500 includes the top panel 502, the top back panel 512, and the top front panel 506 and their associated side and dust flaps are configured to form the hinged top 104 of the assembled outer box 102 when folded. A lower section 564 of the outer box blank 500 includes the bottom panel 504, the bottom front panel 508, the bottom back panel 510 and their associated side and dust flaps discussed below are configured to form the body 105 of the assembled outer box 102 when folded.

The top back panel 512, the bottom front panel 508, and the bottom back panel 510 include left and right flaps. For example, the top front panel 506 includes a left side flap 522 and a right side flap 524; the top back panel 512 includes a left side flap 526 and a right side flap 528; the bottom front panel 508 includes a left side flap 530 and a right side flap 532; and the bottom back panel 510 includes a left side flap 534 and a right side flap 536. Each panel of the outer box 102 and the associated left and right flaps are separated from an adjacent panel and its associated left and right flaps by a transverse fold line. The front flap 513 and the top front panel 506 are separated by transverse fold line 539. The top front panel 506, the left side flap 522, and the right side flap 524 are separated from the top panel 502, the left dust flap 514, and the right dust flap 516, respectively, by transverse fold line 538. The top panel 502, the left dust flap 514, and the right dust flap 516 are separated from the top back panel 512, the left side flap 526, and the right side flap 528, respectively, by transverse fold line 540. The top back panel 512, the left side flap 526, and the right side flap 528 are separated from the bottom back panel 510, the left side flap 534, and the right side flap 536, respectively, by transverse fold line 542. The bottom back panel 510, the left side flap 534, and the right side flap 536 are separated from the bottom panel 504, the left dust flap 518 and the right dust flap 520, respectively, by transverse fold line 544. The bottom panel 504, the left dust flap 518, and the right dust flap 520 are separated from the bottom front panel 508, the left side flap 530, and the right side flap 532, respectively, by transverse fold line 546.

Each side flap and dust flap of the outer box 102 is separated from the associated and adjacent panel by a longitudinal fold line. The top front panel 506 is separated from the left and right side flaps 522, 524 by longitudinal fold lines 548. The right side flap 524 has a pre-cut edge 525 that extends at an angle of approximately −45° from the transverse fold line 539. The left side flap 522 has a pre-cut edge 523 that extends at an angle of approximately −135° from the transverse fold line 539. The top panel 502 is separated from the left and right dust flaps 514, 516 by longitudinal fold lines 550. The top back panel 512 is separated from the left and right side flaps 526, 528 by longitudinal fold lines 552. The left side flap 526 has a pre-cut edge 527 that extends at an angle of approximately −50° from the transverse fold line 542. The right side flap 528 of top back panel 512 has a pre-cut edge 529 that extends at an angle approximately −140° from the transverse fold line 542. The bottom back panel 510 is separated from the left and right side flaps 534, 536 by longitudinal fold lines 554. The left side flap 534 has a pre-cut edge 535 that extends at an angle of approximately −45° from the transverse fold line 542. The right side flap 536 of the bottom back panel 510 has a pre-cut edge 537 that extends at an angle of approximately −135° from the transverse fold line 542. The bottom panel 504 is separated from the left and right dust flaps 518, 520 by longitudinal fold lines 556. The bottom front panel 508 is separated from the left and right side flaps 530, 532 by longitudinal fold lines 558. The left side flap 530 and the right side flap 532 extend past an edge 560 of the bottom front panel 508. The left side flap 530 has a pre-cut edge 531 that extends at approximately −45°, and in a preferred embodiment −39°, from the bottom edge 560 of the bottom front panel 508. The right side flap 532 a pre-cut an edge 533 that extends at approximately −135°, and in a preferred embodiment −129°, from the edge 560 of the front panel 508.

The pre-cut angle of the flaps associated with the bottom front panel 508 and bottom back panel 510 are complementary to the pre-cut angle of the flaps associated with the top front panel 506 and the top back panel 512 so that a side surface of the hinged top of the outer box mates with a side surface of a body of the outer box when the outer box is in a closed state.

The outer box 102 has dimensions suitable for providing a snug fit for the inner package 106 when disposed within the outer box 102. The outer box 102 has a width $W_{OB}$ that is common to each of the top panel 502, bottom panel 504, top front panel 506, bottom front panel 508, bottom back panel 510, and top back panel 512. The bottom back panel 510 has a length $L_{OB-BBP}$ that is substantially longer than the length of the top back panel ($L_{OB-TBP}$) 512. The sum of $L_{OB-BBP}$ and $L_{OB-TBP}$ is approximately equal to the length of a cigarette pack, e.g., the length of the inner package 106. The length of the bottom front panel ($L_{OB-BFP}$) 508 is substantially longer than the length of the top front panel ($L_{OB-TFP}$) 506. The sum of $L_{OB-BFP}$ and $L_{OB-TFP}$ is substantially equal to the sum of $L_{OB-BBP}$ and $L_{OB-TBP}$. According to an exemplary embodiment $L_{OB-BBP}$=75.10 mm, $L_{OB-TBP}$=11.40 mm, $L_{OB-BFP}$=55.5 mm, and $L_{OB-TFP}$=31.0 mm. The depth or thickness of the outer box 102 is equal to the width ($W_{OB-FLP}$) of the side and dust flaps and the length (e.g., shortest edge) of the top panel ($L_{OB-TP}$) 502 and bottom panel ($L_{OB-BP}$) 504. According to an exemplary embodiment $L_{OB-TP}$=$L_{OB-BP}$=$W_{OB-FLP}$=21.9 mm.

Figure 8:
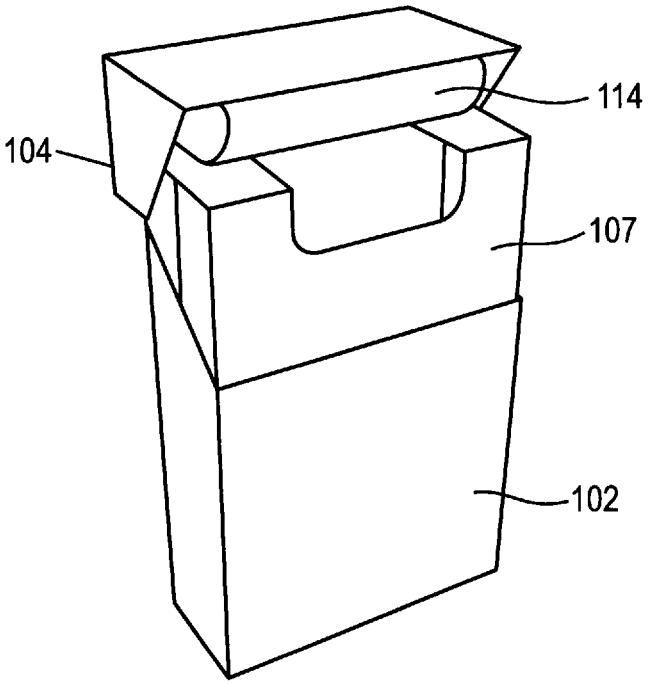
FIG. 8 illustrates an assembled container in an open condition in accordance with an exemplary embodiment.

FIG. 8 illustrates an assembled container in accordance with an exemplary embodiment of the present disclosure. As shown, the assembled container 200 includes the rigid outer box 102, inner package 106, inner frame 107 and pull tab 114. The outer box 102 includes the hinged lid 104 for accessing consumer goods (not shown) in the inner package 106. The pull tab 114 is affixed to an inner surface of the hinged lid 104 established by a folded front flap of the outer box blank 500 via the permanent adhesive. When the hinged lid 104 is closed, the pull tab 114 fully covers the opening 110 of the inner frame 107 by adhering to an outer surface of the inner frame 107 surrounding the opening 110 via the re-sealable adhesive. Alternatively, when the hinged lid 104 is opened, the pull tab 114 uncovers the opening 110 and remains adhered to the hinged lid 104 of the outer box 102 and to the inner package 106 via the areas having the permanent adhesive.

In view of the forgoing, a container 100 of consumer goods 112 can comprise a rigid outer box 102 having a hinged lid 104 configured to provide access to an inner volume of the outer box, an inner package 106 containing the consumer goods 112, an inner frame 107 having an opening 110 configured to provide access to the consumer goods 112, and a pull tab 114 covering the opening 110. The pull tab 114 has a first adhesive that releasably adheres the pull tab 114 to portions of the inner frame 107 surrounding the opening 110 and a second adhesive that permanently adheres the pull tab 114 to the inner package 106 and the rigid outer box 102.

An inner frame blank 200 for forming the inner frame 107 can comprise a front panel 202, a top panel 204 with left and right dust flaps 216, 220, a left side panel 208 and a right side panel 212, the top panel 204 connected to the front panel 202 at a first transversely extending fold line 206, the left side panel 208 connected to the front panel 202 at a first longitudinally extending fold line 210, the right side panel 212 connected to the front panel 202 at a second longitudinally extending fold line 214, and the opening 110 extending part way across the top panel 204 and part way down the front panel 202. The left dust flap 216 can at least partly overlap the left side panel 208 when the left dust flap 216 and left side panel 208 are folded 90 degrees and the right dust flap 220 can at least partly overlap the right side panel 212 when the right dust flap 220 and the right side panel 212 are folded 90 degrees. The inner frame 107 can be formed from the inner frame blank 200 by folding the top panel 90 degrees with respect to the front panel 202, folding the left side panel 90 degrees with respect to the front panel, folding the right side panel 90 degrees with respect to the front panel, folding the left dust panel 90 degrees with respect to the top panel and folding the right dust panel 90 degrees with respect to the top panel.

A container 100 can be assembled from the rigid outer box 102, the inner package 106, the pull tab 114 and the inner frame 107 by wrapping a bundle of cigarettes 112 in the inner package 106, placing the inner frame 107 over an upper end of the inner package 106, placing the pull tab 114 on the inner frame 107 and attaching the pull tab 114 to the inner package 106 and hinged lid 104 such that a first adhesive releasably adheres the pull tab 114 to portions of the inner frame 107 surrounding the opening 110 and a second adhesive adheres the pull tab 114 to the inner package 106 and a hinged lid 104 of the rigid outer box 102. The inner frame 107 can be sized such that the top panel 204 overlies a top face of the inner package 106, the front panel 202 overlies an upper portion of a front face of the inner package 106, the left dust flap 216 and left side panel 208 overlie an upper portion of a left side face of the inner package 106, and the right dust flap 220 and right side panel 212 overlie an upper portion of a right side face of the inner package.

The inner frame 107 preferably does not overlie any part of a rear face of the inner package 106. The second adhesive can include first and second zones of permanent adhesive wherein the first zone attaches a first end of the pull tab 114 to an outer surface of the inner package 106 and the second zone attaches a second end of the pull tab 114 to an inner surface of the hinged lid 104. In an embodiment, the inner package 106 comprises an inner paper layer and an outer foil layer, the inner package 106 covers the cigarettes 112 except in an area corresponding to the opening 110 in the inner frame 107, and/or the inner package 106 comprises a paper layer wrapped around the cigarettes 112, the paper layer comprising a mentholated layer of paper in contact with the cigarettes 112.

FIGS. 10A-E show details of a pull tab in accordance with an embodiment wherein FIG. 10A shows a succession of pull tabs on a backing strip, FIG. 10B shows an outer side of the pull tab with dots of permanent adhesive, FIG. 10C shows an underside of the pull tab with zones of permanent adhesive and re-stick adhesive, FIG. 10D shows an underside of the pull tab with a piece of foil/paper at a location which overlies an extraction opening in the inner frame, and FIG. 10E shows a piece of the foil/paper which is adhered to the underside of the pull tab.

As shown in FIG. 10A, a succession of pull tabs 10 are arranged along a backing strip 12 which can be rolled onto a bobbin for use in a packaging machine which assembles the inner packages. Each pull tab 10 can be peeled from the backing strip 12 and placed over an inner frame 107 arranged on an assembled inner package such that the pull tab is permanently attached to the upper backside of the inner package and the remainder of the pull tab can cover the extraction opening in the top and upper front portions of the inner frame 107.

As shown in FIG. 10B, an outer surface 14 of the pull tab 10 includes dots of permanent adhesive 16 along a portion of the pull tab below a line of weakness 20 formed by a transverse row of perforations, score line, or other mechanical equivalent. The pull tab 10 can optionally include an area 22 of contrasting color and/or gloss or a 100% black eyemark across the upper portion of the pull tab and optional smaller areas 24, 26 of contrasting color and/or gloss or a 100% black eyemark at bottom corners of the pull tab. The pull tabs can have a rectangular shape with parallel upper and lower edges and parallel side edges with square or rounded corners. In the embodiment shown in FIG. 10B, the pull tab 10 has a width slightly smaller than the width of an inner package (illustrated by rectangular outline 11). The pull tab 10 has a length such that when the pull tab 10 is attached to an inner frame, the pull tab 10 covers the top of the inner package and covers the upper portions of the front and back sides of the inner package.

As shown in FIG. 10C, an inner surface 28 of the pull tab 10 includes a rectangular area 30 of permanent adhesive extending across the top of the pull tab and an area 32 of re-stick adhesive extending across the bottom of the pull tab. Depending on machine tolerances, the permanent adhesive 30 and the re-stick adhesive 32 are preferably applied to the pull tab with an adhesive-free gap 34 between them. The gap 34 provides an air vent which allows air to escape from inside the inner box when the pull tab 10 closes the extraction opening in the inner frame. For example, the gap 34 can be about 1 mm wide and located about 3 mm from the location of the extraction opening (illustrated by dotted lines 18). The line of perforations 20 can be located about 2 mm below the location of the extraction opening and about 8 mm above a lower edge of the pull tab. As an example of the pull tab and extraction opening dimensions, the extraction opening can be about 30 mm wide and about 32.5 mm long and the pull tab 10 can be about 50 mm wide and about 65 mm long.

As shown in FIG. 10C, the re-stick adhesive 32 covers the pull tab except along the lower side edges 34, 36 and bottom edge 38 of the pull tab 10. For example, the re-stick adhesive can be applied in a pattern which has a weaker adhesion force at the bottom edge 38 of the pull tab 10 and a stronger adhesion force above the line of perforations 20. The line of perforations 20 forms a connecting tab 40 which is permanently attached to the inside of the hinged lid of the outer box. Thus, when the hinged lid is opened, the re-stick adhesive 32 on the underside of the connecting tab 40 provides a weaker adhesion force holding the pull tab 10 to the outer surface of the inner frame than the remainder of the re-stick adhesive above the line of perforations 20.

In an embodiment, the lower portion of the re-stick adhesive can be applied with a saw tooth pattern 42 extending across the connecting tab 40. In the saw tooth pattern shown in FIG. 10C, four triangular regions of re-stick adhesive cover about 40 to 60% of the connecting tab 40. Preferably, the area of re-stick adhesive is smallest (e.g., minimum) at the bottom edge 38 of the pull tab, larger (e.g., midpoint) at the line of perforations 20 and largest (e.g., maximum) at a location above the line of perforations 20. For example, the re-stick adhesive 32 can begin to decrease in area at about 16 mm above the bottom edge 38, decrease in area by about 50% or less at the location of the line of perforations 20, and reach a minimum at about 1 mm from the bottom edge 38 of the pull tab 10.

FIG. 10D shows the pull tab 10 with a piece of foil/paper 44 adhered to the re-stick adhesive 32 so as to cover the location of the extraction opening (illustrated with dotted lines 18). For example, the foil/paper piece 44 can be a piece of bundle wrap typically used to wrap a bundle of cigarettes and the piece 44 is adhered to the pull tab 10 with the paper side of the piece 44 exposed. When the pull tab 10 is applied to an inner package containing cigarettes, the paper side of the piece 44 will be in contact with ends of the cigarettes. As an example of part dimensions, the piece 44 can be sized to extend about 2 mm beyond the extraction opening (illustrated by dotted lines 18). FIG. 10E shows the piece 44 prior to being attached to the pull tab 10. In the case of an extraction opening about 30 mm wide and about 32.5 mm long, the piece 44 can be about 34 mm wide and about 36.5 mm long. The extraction opening can have rounded corners (as illustrated by the dotted lines 18 in FIG. 10D) and the piece 44 can also have rounded corners as shown in FIG. 10E.

The container can have various design features. For example, the consumer goods can comprise a bundle of loose smoking articles and the pull tab can comprise a flexible sheet of polymer material having re-stick adhesive on the underside thereof wherein the paper liner comprises a substantially square piece of bundle wrap adhered to the pull tab by the re-stick adhesive such that a paper side of the bundle wrap is exposed and faces the smoking articles in the inner package.

The pull tab can be rectangular in shape and cover at least 90% of a width of the front, top and back walls, the pull tab including a rectilinear line of weakening extending across the pull tab at a predetermined distance from a bottom edge of the pull tab such that a portion of the pull tab below the line of weakening forming a rectangular connecting tab adhered to the inner surface of the hinged lid with the permanent adhesive.

In a preferred embodiment, the pull tab can be attached to the hinged lid by permanent adhesive attaching an outer surface of the pull tab to the inner surface of the hinged lid and the pull tab is attached to the inner package by permanent adhesive attaching an inner surface of the pull tab to an upper portion of the back wall of the inner package. The pull tab can comprise a film of polyethylene terephthalate (PET) and the paper liner can comprise a piece of paper laminated to metal foil.

In an embodiment, the container includes an outer box having the size of a traditional cigarette pack. For instance, the outer box can have a height of about 3 to 4 inches, a width of about 2 to 2.5 inches, and a thickness of about 1 to 1.25 inches with the inner package sized to fit snugly within the outer box. For example, the outer box can be about 88 mm high, about 56 mm wide and about 23 mm thick, with the inner package being about 86 mm high, 55 mm wide, and 22 mm thick. The size of the container will depend on the size of the consumer goods. Where the consumer goods are cigarettes, the size of the container can be designed to accommodate 20 cigarettes having lengths of 40 to 180 mm and diameters of 4 to 9 mm. Thus, the outer dimensions of the container will be slightly larger than the dimensions of the cigarette bundle, e.g., the height, width and thickness of the container can be at least 1 mm larger in each direction than the dimensions of an unwrapped cigarette bundle.

The pull tab can be a rectangular shaped sheet with a width of about 50 mm and a length of about 65 mm. The paper liner can be a rectangular shaped sheet with a width of about 34 mm and a length of about 36 mm. The pull tab can include a rectilinear line of weakening located about 8 mm from one end of the pull tab to form a connecting tab at the bottom of the pull tab.

The pull tab can include one or more machine readable markings on an inner surface and/or outer surface. For example, the pull tab can include a large black mark extending completely across the upper end of the underside of the pull tab and smaller black marks at opposite lower corners on the upper side of the pull tab.

The paper liner can have an outer periphery which extends about 2 mm beyond an outer periphery of the opening. The pull tab can be permanently adhered to the back wall of the inner package. The opening can have a width of about 30 mm and a depth of about 16 mm in the top wall of the inner frame and a width of about 30 mm and a depth of about 16 mm in the front wall of the inner frame. The pull tab can also include a connecting tab defined by a rectilinear line of 2.5 mm long perforations located about 8 mm from a lower edge of the pull tab.

The connecting tab can include an adhesive-free area such as an area of deadened adhesive and a re-stick adhesive area on an inner surface thereof, the adhesive-free area decreasing in size in a direction away from a lower edge of the connecting tab and the re-stick adhesive area decreasing in size in a direction towards the lower edge. The permanent adhesive can be located in first and second zones, the first zone located at an upper portion of the inner surface of the pull tab and the second zone located at a lower portion of an outer surface of the pull tab, the second zone of permanent adhesive attaching the connecting tab to an inside surface of the hinged lid, the re-stick adhesive area forming part of a single zone of re-stick adhesive extending from the connecting tab to the first zone of permanent adhesive.

In various design variations, (a) the pull tab can comprise a piece of polymer film having a substantially rectangular shape with parallel upper and lower edges and parallel side edges, the side edges having a length greater than a width of the upper and lower edges, (b) the first zone of permanent adhesive can have a rectangular shape extending about 30% of the length of the pull tab and the single zone of re-stick adhesive can have a substantially rectangular shape extending about 70% of the length of the pull tab, (c) the first zone of permanent adhesive can be separated from the single zone of re-stick adhesive by a uniform gap about 1 to about 2 mm wide, (d) the single zone of re-stick adhesive can include an upper border parallel to the upper edge of the pull tab, side borders parallel to the side edges of the pull tab, and a lower border which provides a decreasing area of re-stick adhesive in a direction towards the lower edge of the pull tab, (e) an adhesive-free border can extend completely around the inner surface of the pull tab with the adhesive-free border extending no more than about 2 mm from the outer periphery of the pull tab, (f) the adhesive-free gap can extend completely across the pull tab to the adhesive-free border on opposite sides of the pull tab, and/or (g) the pull tab can include at least one machine readable marking on an inner and/or outer surface thereof.

In an embodiment, the pull tab can include a line of weakening such a line of perforations extending transversely across the pull tab at a location corresponding to the upper back edge of the inner package, i.e., the edge between the back panel and the top panel. The first zone of permanent adhesive can extend over the line of weakness such that when the pull tab is attached to an inner package, the line of weakness is aligned with the top back edge of the inner package and the first zone of permanent adhesive contacts the an upper portion of the back panel and a portion of the top panel adjacent the back panel. As an example, the line of weakening can be arranged such that about 80% of the first zone of permanent adhesive is located on the back panel of the inner package and about 20% of the first zone of adhesive is located on the top panel of the inner package.

In another embodiment, the pull tab can include re-seal adhesive covering the connecting tab with one or more areas of the re-seal adhesive deadened to promote peeling of the pull tab when the outer box is opened. FIGS. 11A-H show variations of where the re-seal adhesive 32 can be deadened.

Figure 11A:
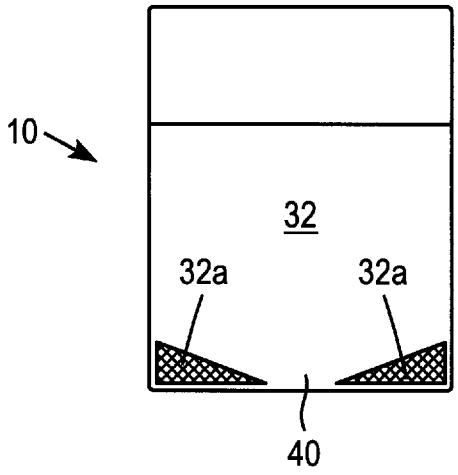

FIG. 11A shows Option A wherein the re-seal adhesive 32 is deadened in two spaced apart triangular regions 32*a* at the lower corners of the connecting tab 40, each of the triangular regions 32*a* having a length at one end about equal to the length of the connecting tab 40 and decreasing in area in a direction towards a center of the connecting tab 40.

Figure 11B:
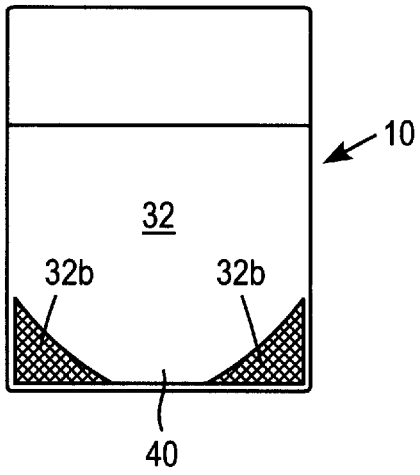

FIG. 11B shows Option B wherein the re-seal adhesive 32 is deadened in two spaced apart arcuate regions 32*b* located at the lower corners of the connecting tab 40, each of the arcuate regions 32*b* having a length greater than a length of the connecting tab 40 and decreasing in area in a direction towards a center of the connecting tab 40.

Figure 11C:
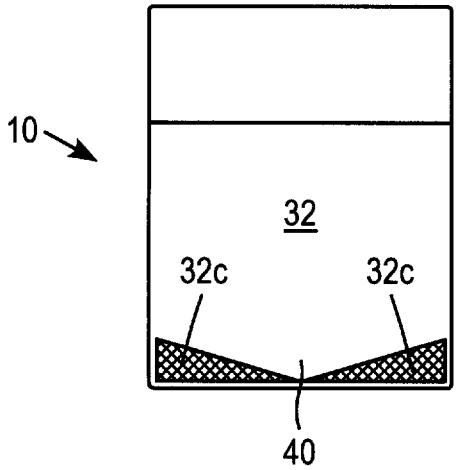

FIG. 11C shows Option C wherein the re-seal adhesive 32 is deadened in two triangular regions located 32*c* at lower corners of the connecting tab 40, each of the triangular regions 32*c* having a length about equal to a length of the connecting tab 40 and decreasing in area from an outer edge of the connecting tab to the center of the connecting tab 40.

Figure 11D:
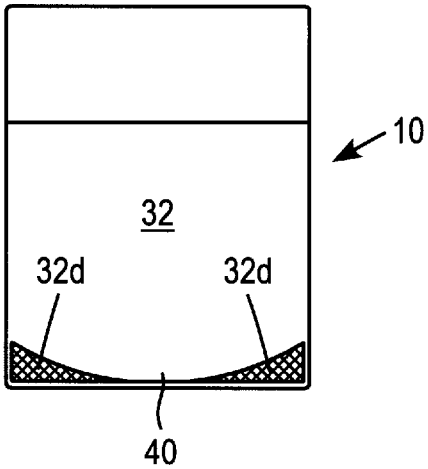

FIG. 11D shows Option D wherein the re-seal adhesive 32 is deadened in two arcuate regions 32*d* located at lower corners of the connecting tab 40, each of the arcuate regions 32*d* having a length about equal to the length of the connecting tab 40 and decreasing in area from the outer edge of the connecting tab to the center of the connecting tab 40.

Figure 11E:
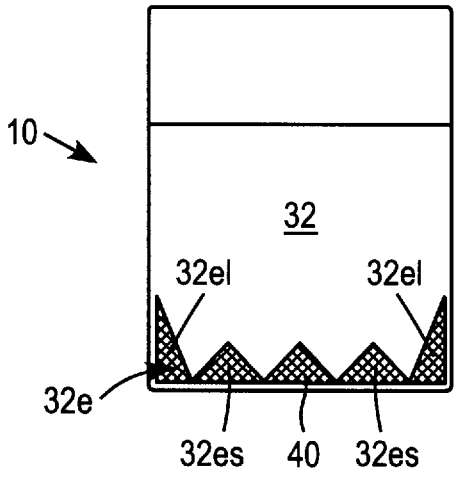

FIG. 11E shows Option E wherein the re-seal adhesive 32 is deadened in a sawtooth pattern of triangular regions 32*e* extending from the lower edge of the connecting tab 40, the triangular regions 32*e* including two long portions 32*el* and three short portions 32*es*, the long portions 32*el* having a length greater than the length of the connecting tab 40 and decreasing in area in a direction towards the center of the connecting tab 40 and the short portions 32*es* having a length about equal to the length of the connecting tab 40 and increasing in area in a direction towards a bottom edge of the connecting tab 40.

Figure 11F:
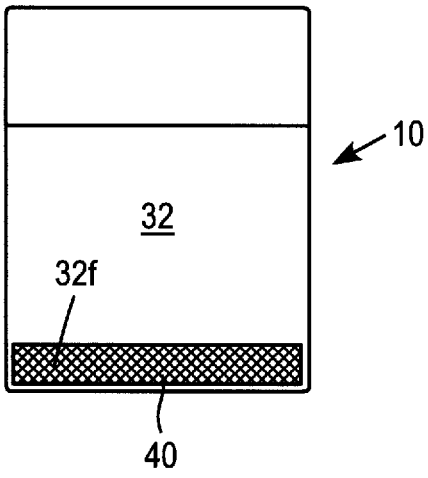

FIG. 11F shows Option F wherein the re-seal adhesive 32 is deadened in a rectangular region 32*f* about the size of the connecting tab 40.

Figure 11G:
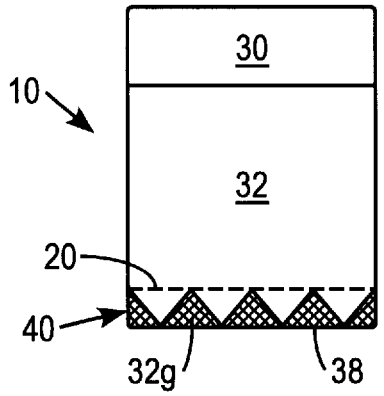

FIG. 11G shows Option G wherein the re-seal adhesive 32 is deadened in a sawtooth pattern 32*g* with triangular regions of deadened adhesive extending about 7.5 mm from the bottom edge 38 to the line of weakness 20 forming the connecting tab 40. The sawtooth pattern 32*g* of deadened adhesive can provide four triangular areas of re-seal adhesive 32 which converge at four points spaced apart along the bottom edge by about 12 mm.

Figure 11H:
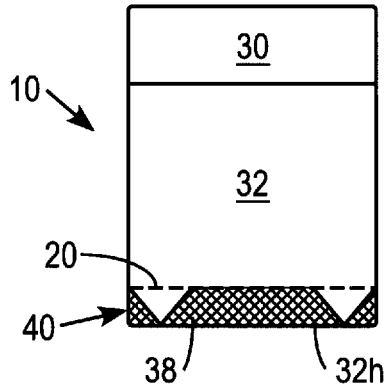

FIG. 11H shows Option H wherein re-seal adhesive 32 is deadened in a pattern 32*h* which is trapezoidal across the center of the connecting tab 40 and triangular at each end such that two triangular areas of re-seal adhesive which converge at two points along the bottom edge 38, each point spaced about 6.5 mm from a side edge of the pull tab 10.

FIG. 12 shows a pull tab 10 with a large machine readable mark 22 at an upper end of an outer surface of the pull tab 10 and two smaller machine readable marks 24, 26 at opposite corners of the connecting tab 40. As shown, the smaller marks 24, 26 extend from the bottom edge 38 slightly beyond the line of weakness 20.

FIG. 13 shows an underside of a pull tab 10 wherein a line of weakness 21 extends through the permanent adhesive 30 such that the line 21 coincides with the upper corner between the back wall and the top wall of an inner package. The permanent adhesive covers about 30% of the pull tab 10 and the restick adhesive 32 covers the rest of the pull tab. The line of weakness 20 extends through the restick adhesive 32 and forms the connecting tab 40.

FIG. 14 shows the pull tab 10 with the liner 44 attached to the restick adhesive 32 at a location between the lines of weakness 20, 21.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A container for consumer goods, comprising:

a rigid outer box having a hinged lid configured to provide access to an inner volume of the rigid outer box;

an inner package containing the consumer goods;

an inner frame having an opening configured to provide access to the consumer goods, the inner frame including a top panel overlying a top face of the inner package, a front panel overlying an upper portion of a front face of the inner package, a left dust flap overlying an upper portion of a left side of the inner package, a right dust flap overlying an upper portion of a right side of the inner package, and the inner frame not overlying any part of a rear face of the inner package; and a pull tab covering the opening, the pull tab having a first adhesive that releasably adheres the pull tab to portions of the inner frame surrounding the opening and a second adhesive that permanently adheres the pull tab to the inner package and the hinged lid of the outer box;

wherein the inner frame includes a left side panel and a right side panel, the top panel connected to the front panel at a first transversely extending fold line, the left side panel connected to the front panel at a first longitudinally extending fold line, the right side panel connected to the front panel at a second longitudinally extending fold line, the opening extending part way across the top panel and part way down the front panel, the left dust flap at least partly overlapping the left side panel and the right dust flap at least partly overlapping the right side panel.

2. The container of claim 1, wherein the inner package is bundle wrap.

3. The container of claim 1, wherein the inner frame comprises paperboard.

4. The container of claim 1, wherein the consumer goods are cigarettes wrapped in the inner package and the inner package is a mentholated bundle wrap.

5. The container of claim 4, wherein the inner package is open in an area corresponding to the opening in the inner frame.

6. The container of claim 1, wherein an outer surface of the inner frame is adhered to an inner surface of the rigid outer box.

7. The container of claim 1, wherein a front panel of the rigid outer box overlies a portion of the front panel of the inner frame.

8. The container of claim 7, wherein a side panel of the rigid outer box partly overlies the right side panel or the left side panel of the inner frame.

* * * * *